United States Patent [19]

Jarvis

[11] Patent Number: 4,838,564

[45] Date of Patent: Jun. 13, 1989

[54] STEERABLE ROLLER SKATE

[76] Inventor: Patrick T. Jarvis, 6009 Highview St., Dearborn Heights, Mich. 48127

[21] Appl. No.: 656,479

[22] Filed: Oct. 1, 1984

[51] Int. Cl.[4] ..... A63C 1/24

[52] U.S. Cl. ..... 280/11.28; 280/11.23

[58] Field of Search ..... 280/11.23, 11.27, 11.28, 280/11.19, 11.1 BR

[56] References Cited

U.S. PATENT DOCUMENTS

| | | | |
|---|---|---|---|
| 103,346 | 5/1870 | Lemman | 280/11.19 |
| 200,186 | 2/1878 | Forsyth | 280/11.28 |
| 2,204,280 | 6/1940 | Meister | 280/11.23 |
| 2,529,314 | 11/1950 | Schmid | 280/11.23 |
| 2,719,724 | 10/1955 | Lundgren | 280/11.23 |
| 3,414,280 | 12/1968 | Ohashi | 280/11.19 |
| 4,153,263 | 5/1979 | Yoshimoto | 280/11.1 BR |
| 4,294,456 | 10/1981 | Tuell et al. | 280/11.23 |

FOREIGN PATENT DOCUMENTS

| | | | |
|---|---|---|---|
| 2724396 | 11/1978 | Fed. Rep. of Germany | 280/11.19 |
| 2903174 | 7/1980 | Fed. Rep. of Germany | 280/11.1 BR |
| 2938316 | 4/1981 | Fed. Rep. of Germany | 280/11.23 |
| 436795 | 2/1912 | France | 280/11.23 |
| 282418 | 8/1952 | Sweden | 280/11.23 |
| 11727 | of 1910 | United Kingdom | 280/11.27 |
| 741159 | 11/1955 | United Kingdom | 280/11.23 |

*Primary Examiner*—Charles A. Marmor
*Assistant Examiner*—Eric Culbreth
*Attorney, Agent, or Firm*—Lloyd M. Forster

[57] ABSTRACT

Roller skates provided with essentially spherical wheels mounted on trucks pivotally connected to a sole plate with longitudinally offset skate wheel axes and yieldable resilient neutralizing bias accommodating steering truck displacement in response to skater leaning.

2 Claims, 2 Drawing Sheets

STEERABLE ROLLER SKATE

BACKGROUND OF THE INVENTION

Roller skates in current use which accommodate turning have two basic designs commonly termed "conventional" and "roller blade". Conventional skates have four flat wheels mounted on an external boot plate for each skate and get their turning action when the plate and boot are leaned to one side or the other. The whhels and truck remain horizontal to the skating surface but rotate slightly turning the skate in the direction of leaning. The trucks mount to the plate with a bolt having rubber cushions on one end of the truck and a free moving pivot at the other end.

Roller blade skates are designed somewhat similar to ice skates using relatively narrow rounded wheels in longitudinal alignment having an arcuate contact profile extending to the lowest point at the middle. The skate can lean on any one of the wheels while the plate and truck remain in line because of the rounded sides of the wheels. The skate gets its turning action with limited rocking back and forth while leaning in a manner similar to an ice skate. Roller blades normally have five wheels in line per skate that mount directly to the plate with no turning or leaning movements.

BRIEF SUMMARY OF THE PRESENT INVENTION

A preferred embodiment employs four substantially semispherical wheels per skate with forward and rear pairs each mounted on a truck which can pivot to provide steering displacement of its axle. The trucks are resiliently biased to a neutral position subject to displacement by leaning the skate to either side with floor contact longitudinally spaced relative to the pivot to generate limited arcuate truck displacement turning the skate in the direction leaned. When the skate is vertical, wheels and trucks are restored to neutral position by springs or rubber cushions which may be optionally provided for effecting appropriate neutral bias.

The skates have been found to provide roller skate characteristics simulating ice skates with regard to traction against side slipping but with supplemental steering action to facilitate turning. They are somewhat more stable than ice skates and lighter and more nimble than conventional roller skates made with comparable materials. The skater's weight is always in direct line with the contact point of the wheels providing superior traction relative to conventional roller skates.

BRIEF DESCRIPTION OF THE DRAWINGS

With reference to FIG. 1 each skate comprises mounting plate 11, with forward truck 12 pivotally connected at 13 having a pair of substantially semispherical skate wheels 14 mounted on axle 15 rigidly secured to central web 16 depending from truck plate 17. Similar rear wheel and truck assembly 18 pivotally connected at 19 to plate 11 is connected by tension spring 20 to the forward truck assembly biasing the respective trucks to neutral position. Anti-friction pad surfaces 21 interposed between truck plate 17 and longitudinal plate 11 accommodate pivotal movement of trucks 12 against neutralizing bias of spring 20 when side tilting of the skate through skater's shoe 22, suitably secured to plate 11, creates a side load, as at point 23 below axle 15, longitudinally displaced from pivot 13 under the ball of the skater's foot as well as a similar side load, as at point 24 under rear axle 25 longitudinally displaced from pivot 19, whereby both front and rear wheel assemblies are pivotally displaced against the bias of spring 20 to a steering attitude in the direction of tilting.

Figure 1:
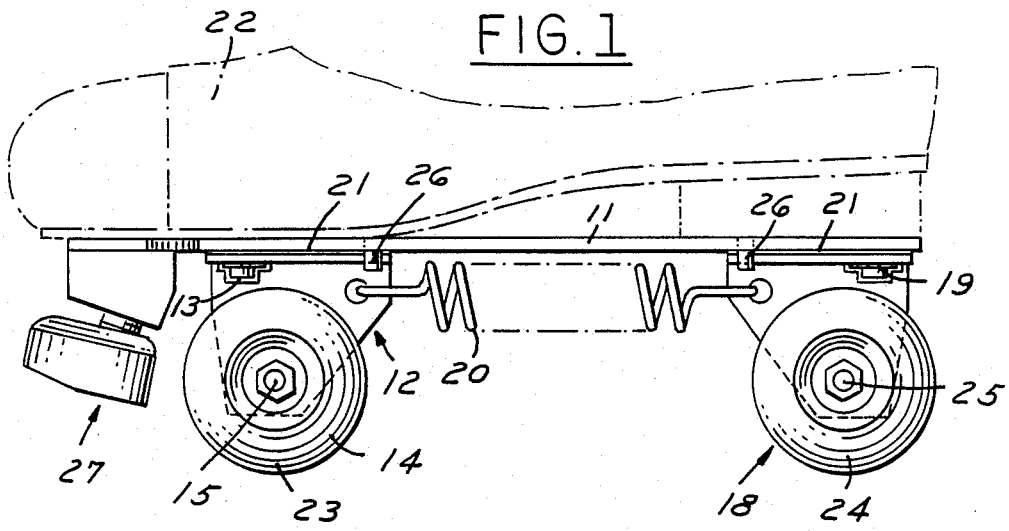
FIG. 1 is a side elevation of a first embodiment of the present invention.

Limit stops 26 in the form of depending pins or semi-pierced projections limit the angular pivotal deflection of respective wheel assemblies to a maximum displacement corresponding to a minimum radius of turning curvature required for any skating maneuver.

Conventional toe brake 27 may be optionally provided, particularly where the skates are to be used for indoor floor skating.

In order to achieve appropriate turning action for the respective wheel assemblies under the various skating turns made in normal use, a number of interrelated factors are involved. The rate of spring 20 as well as preload tension in the neutral position shown will establish the bias opposing turning deflection, the longitudinal spacing between pivots 13 and 19 and respective axles 15 and 25 establish the effective pivotal turning moment from any given off-center load on contact points 23 and 24 from side tilting imposed on plate 11 by the skater, the skater's weight of course comprising a factor of such moment. It is clear that too little preload and too great a longitudinal spacing between axles and pivots for a given weight of skater will result in oversteer and lack of comfortable control through natural tilting for a given arcuate skating path. Another factor involved is the centrifugal force arising from the arcuate path of the skater which increases with the skater's speed and which provides an opposing moment to the steering moment incident to the off-center weight of the skater. Since increasing speed involves increasing tilting to negotiate a given arcuate path, as in the case of bicycle riding, to achieve a balanced condition over the contact points of the wheels the respective opposing moments from skater's weight and centrifugal force increase and decrease together with the speed of skating and appropriate tilting of the skates and the values of the respective factors described above should be adjusted so that the moment incident to the skater's weight and tilting will always predominate and thereby result in correct steering direction.

Through an empirical trial and error it has been found in a typical case for a 140 pound skater, longitudinal pivotal spacing of $8\frac{1}{4}''$, wheel axle spacing of $7\frac{1}{8}''$ centered between pivot axes, active spring length of $3\frac{1}{4}''$, spring preload of 37 pounds and spring rate of 24 lbs. per inch with wheels having $1\frac{1}{4}''$ radius of curvature provides excellent results for a competent experienced skater under all skating speeds and feasible turning paths within the adhering tractive capacity of the skates employing conventional urethane skate wheel material on conventional indoor skating rink surfaces.

Figure 2:
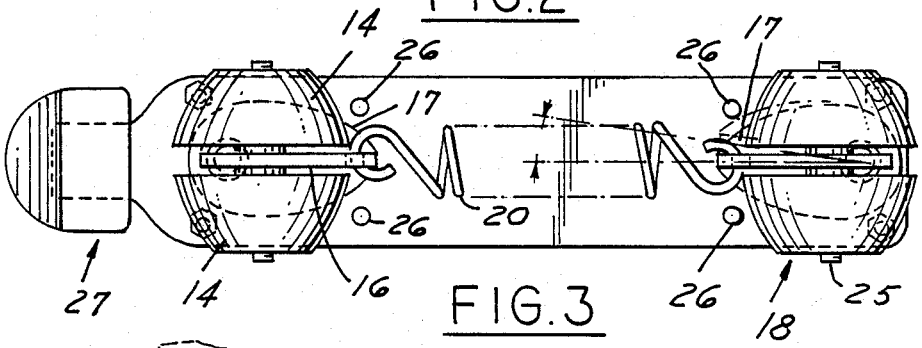
FIG. 2 is a bottom view of the embodiment shown in FIG. 1.
Figure 3:
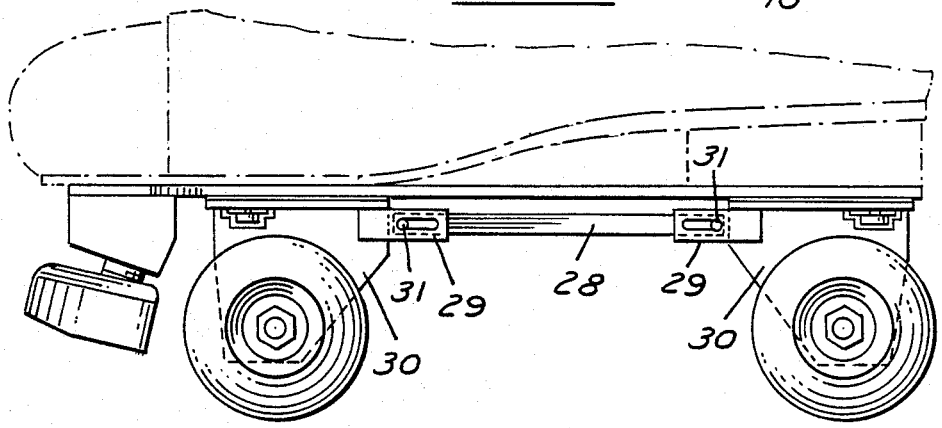
FIG. 3 is a side elevation of a second embodiment.
Figure 4:
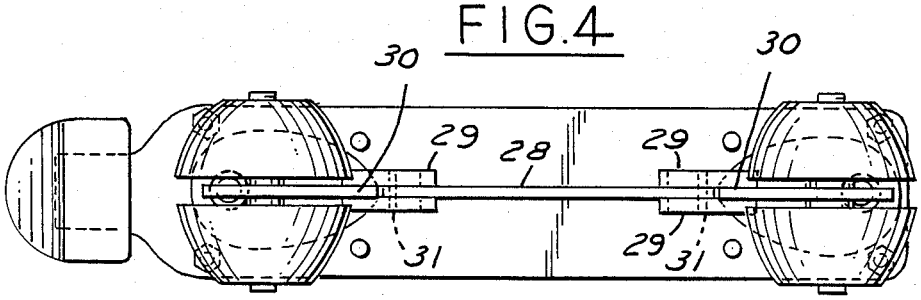
FIG. 4 is a bottom view of the second embodiment.

Alternative spring means for achieving appropriate neutral bias are shown in FIGS. 3 and 4 employing leaf spring 28 in place of tension coil spring 20. Slotted yokes 29 secured to vertical webs 30 provide bifurcated connection for ends of spring 28, secured with transverse pins 31. Turning action imposes bending stress on end leaf spring 28 within limits of axle pivotal displacement. Absence of preload possibilities with this design provide one less control factor in the spring action as compared to the tension spring 20 of FIGS. 1 and 2.

Figure 5:
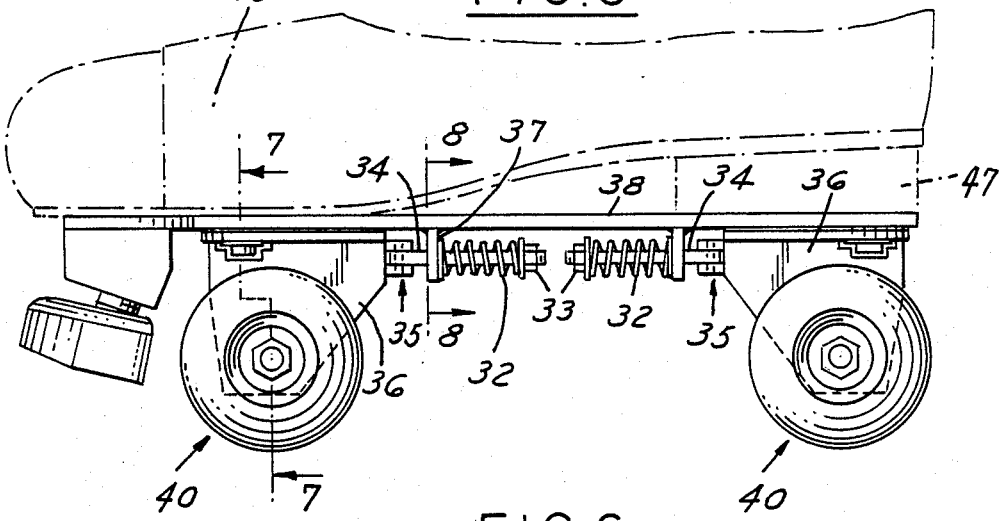
FIG. 5 is a side elevation of a preferred embodiment.
Figure 6:
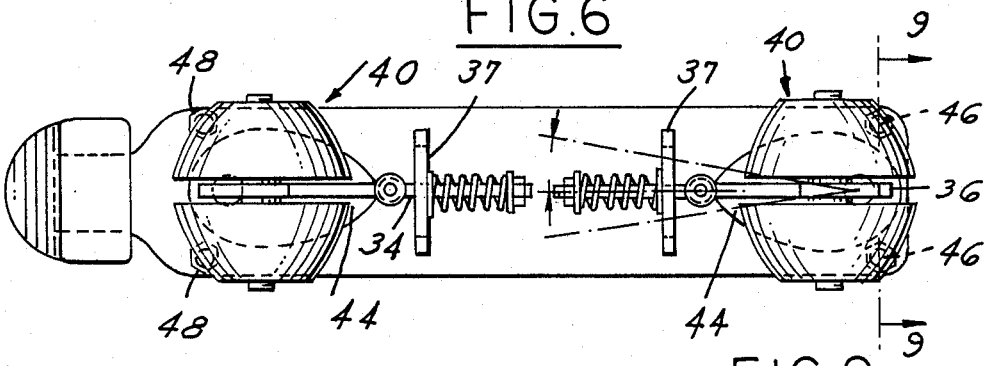
FIG. 6 is a bottom view of the FIG. 5 embodiment.

With reference to FIGS. 5 and 6 a preferred embodiment of adjustable spring bias is disclosed wherein a pair of independent compression springs 32 are individually adjustable through threaded nuts 33 on stems 34 pivotally connected at 35 to vertical webs 36 with slotted shoulder projections 37 welded to plate 38 serving as reaction seats for compression springs 32. With this construction a simple adjustment is provided to change the preload for fine tuning the action of the individual weight of the skater and selectively interchangeable springs of varying rate may be readily substituted for skaters of substantially different weight.

Figure 7:
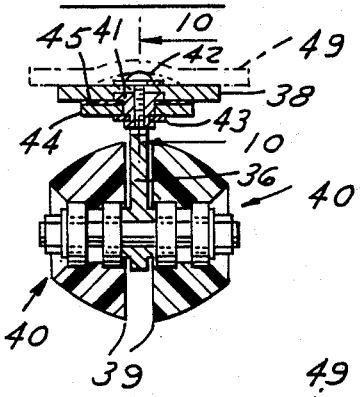
FIG. 7 is a sectional view taken along the line 7—7 of FIG. 5.
Figure 8:
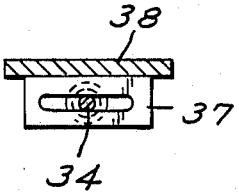
FIG. 8 is a sectional view taken along the line 8—8 of FIG. 5.

With reference to FIG. 7 the cross section of a pair of essentially semi-spherical roller skate wheels 39 employ conventional anti-friction bearings 40 mounted on vertical web 36 with pivotal coupling shown to include shouldered stem 41 retained by screw 42 with clip 43 connecting horizontal flange 44 of the T-shaped truck having anti-friction surface 45 to facilitate pivotal action.

Figure 9:
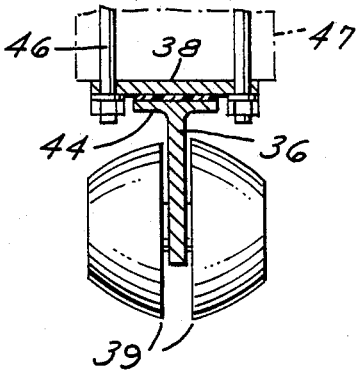
FIG. 9 is a sectional view taken along the line 9—9 of FIG. 6.
Figure 10:
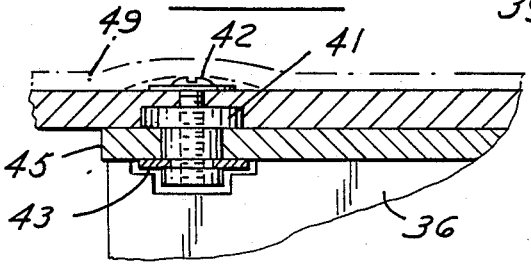
FIG. 10 is a sectional view taken along the line 10—10 of FIG. 7.

With reference to FIG. 9 suitable means such as threaded screws 46 may be employed to connect shoe heel 47 to plate 38 with similar screws 48 adapted to connect a shoe sole of shoe 49 substantially under the ball of the skater's foot.

The compound action of dual steerable trucks provides consistent feel for a skater turning while skating either forwards or backwards.

I claim:

1. Roller skate comprising pair of longitudinally spaced roller means mounted on longitudinally extending member, each of said roller means having a roller axis and transversely arcuate longitudinally split rolling surfaces diminishing tranversely outwardly in rolling radius, each of said roller means having a truck with a vertical pivotal axis outboard of a horizontal displaceably mounted axle capable of providing steering action in an arcuate path, longitudinally extending progressive rate resilient means for biasing each truck to a neutral position, and means responsive to the weight of a skater leaning on said longitudinally extending member for displacing said truck and axle against progressively increasing rate resistance of said resilient means to steer said skate in the direction of leaning, said resilient means being preloaded to resist displacement from neutral position.

2. Roller skate of claim 1 wherein both longitudinal spaced roller means are provided with like steering action means.

* * * * *